US006357073B1

(12) United States Patent
Yue

(10) Patent No.: US 6,357,073 B1
(45) Date of Patent: Mar. 19, 2002

(54) TOOTHBRUSH

(76) Inventor: Choy Heung Yue, Flat 1, 18th Floor, Princess Mansion, 165 King's Road, Hong Kong (HK)

( * ) Notice: Subject to any disclaimer, the term of this patent is extended or adjusted under 35 U.S.C. 154(b) by 0 days.

(21) Appl. No.: 09/546,541

(22) Filed: Apr. 10, 2000

(51) Int. Cl.[7] ..... A46B 9/04
(52) U.S. Cl. ..... 15/167.1; 15/172
(58) Field of Search ..... 15/167.1, 172

(56) References Cited

U.S. PATENT DOCUMENTS 1,466,723 A * 9/1923 Izawa
2,003,243 A * 5/1935 Campbell
2,244,098 A * 6/1941 Busick
2,254,365 A * 9/1941 Griffith
5,655,249 A 8/1997 Li

FOREIGN PATENT DOCUMENTS

| | | | | |
|---|---|---|---|---|
| DE | 283892 | * | 4/1915 | ..... 15/167.1 |
| DE | 704920 | * | 4/1941 | ..... 15/167.1 |
| DE | 42 02 312 | * | 8/1993 | ..... 15/172 |
| WO | PCT/US97/04980 | | 10/1997 | |
| WO | PCT/EP97/03366 | | 12/1997 | |

* cited by examiner

*Primary Examiner*—Randall E. Chin
(74) *Attorney, Agent, or Firm*—Jackson Walker L.L.P.

(57) ABSTRACT

A toothbrush has a push rod, mounted inside a shank, that is operated by a lever. The push rod extends to a remote end of an elongate flexible head attached at a first end to the shank. The push rod can be used to pull the remote end of the head towards shank so that a convex shaped head adopts a planar or concave shape when desired.

4 Claims, 1 Drawing Sheet

TOOTHBRUSH

BACKGROUND OF THE INVENTION

1. Field of the Invention

The invention relates to toothbrushes.

2. Description of Prior Art

Toothbrushes, both manual and electrically operated, have a shank extending from a handle to a brush head on which is carried an array of bristles for brushing teeth. Various fixed shapes and configurations for providing different overall brush-contacting surfaces are well-known. It has been appreciated for a long time that certain shapes, concave or convex, say, are preferred for certain uses and for brushing outer surfaces of the front teeth and inner surfaces of the front teeth respectively. Compromised design arrangements, including complicated overall bristle surfaces or mixed (concave and convex) shapes may be formed on a single brush head. More recently, flexible brush heads have been used that can be normally altered to provide different desired bristle configurations. In those cases, the brush head is made of flexible or deformable material that can retain different shapes, to present bristles in concave or convex configurations say, after each manual manipulation into a desired shape for use. This requires that the user grips the brush head which may not be convenient if the bristles are wet or coated with toothpaste, and is in any event often unhygienic.

SUMMARY OF THE INVENTION

It is an object of the invention to overcome or at least reduce this problem.

According to the invention there is provided a toothbrush having an elongate shank with a longitudinal axis, an elongate brush head formed of flexible material joined end to end along the longitudinal axis to a remote end of the shank and carrying an array of bristles on one major surface thereof, a push rod extending along the shank coupled to a remote end of the brush head, a lever mounted to the toothbrush for moving the push rod generally along the longitudinal axis to alter an effective length of brush head and change the shape of the major surface between a concave shape and a convex shape.

The head is preferably formed with laterally extending slots in said major surface to facilitate bending of the head into said concave and convex shape.

The lever may be rotatably mounted to the toothbrush and formed with an arcuate surface that is mechanically coupled to one end of the push rod so that when the lever is rotated the push rod is moved along the longitudinal axis. The arcuate surface is preferably formed with steps that determine incremental movement of the push rod as the lever is rotated.

The lever may be mounted inside the toothbrush and extends proud of an exterior surface thereof to enable an exposed part of the lever to be conveniently thumb-operated to adjust the shape of the head.

BRIEF DESCRIPTION OF THE DRAWINGS

A toothbrush according to the invention will now be described by way of example with reference to the accompanying drawings in which.

DESCRIPTION OF THE PREFERRED EMBODIMENTS

Figure 1:
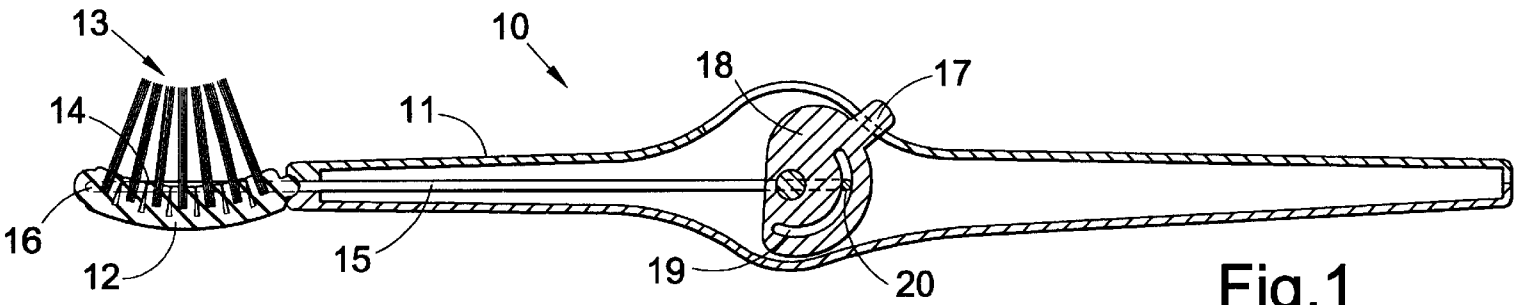
FIG. 1 is a sectional side view of the toothbrush in one configuration.

Referring to the drawings, a toothbrush 10 has an elongate shank 11 and an elongate flexible brush head 12. An array of bristles 13 is mounted on one major surface 14 of the head 12. A straight push rod 15 extends along inside the shank 11 and is coupled to a remote end 16 of the head 12. A lever 17, which extends out of a housing 18, is rotatably mounted inside the toothbrush 10. The housing 18 has an arcuate groove 19 formed with a stepped surface against which a hooked end 20 of the push rod 15 bears.

The surface 14 is formed with laterally extending slots 21 (best seen in FIG. 3) that enables the head to adopt, more easily, a concave shape shown in FIG. 1. An end of the lever 17 is exposed proud of an outer surface of the toothbrush 10 and so can conveniently be operated (pushed and pulled) by a thumb of a user.

In use, the lever 17 is used to alter the shape of the toothbrush head and to retain a chosen shape by the hooked end 20 resting on one of the steps in the slot 19. The head 12 can be changed in shape so that the surface 14 can vary between the concave shape shown in FIG. 1 to the convex shape shown in FIG. 3. This is because operation of the lever 17, and longitudinal movement of the push rod 15, alters the effective length of the head 12.

Figure 2:
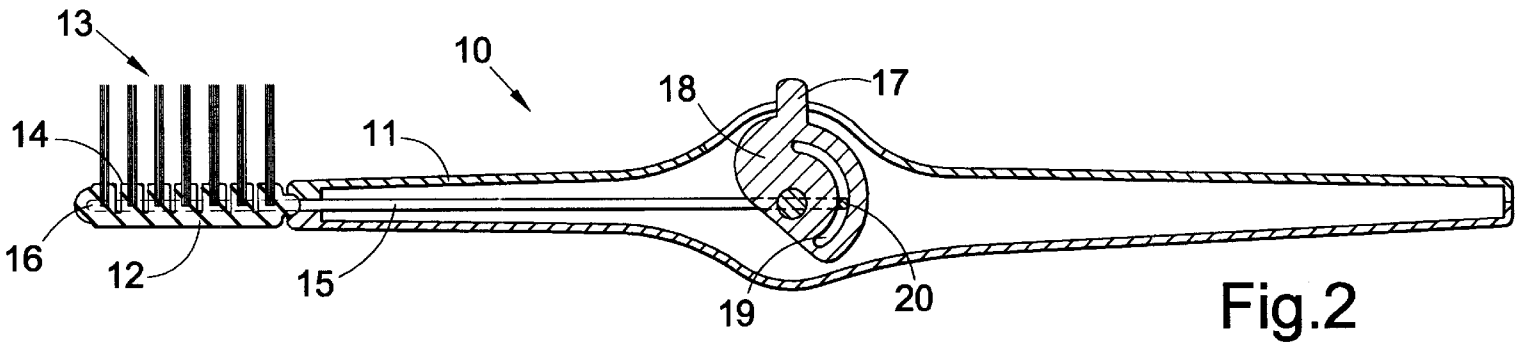
FIG. 2 is a sectional side view of the toothbrush in another configuration.
Figure 3:
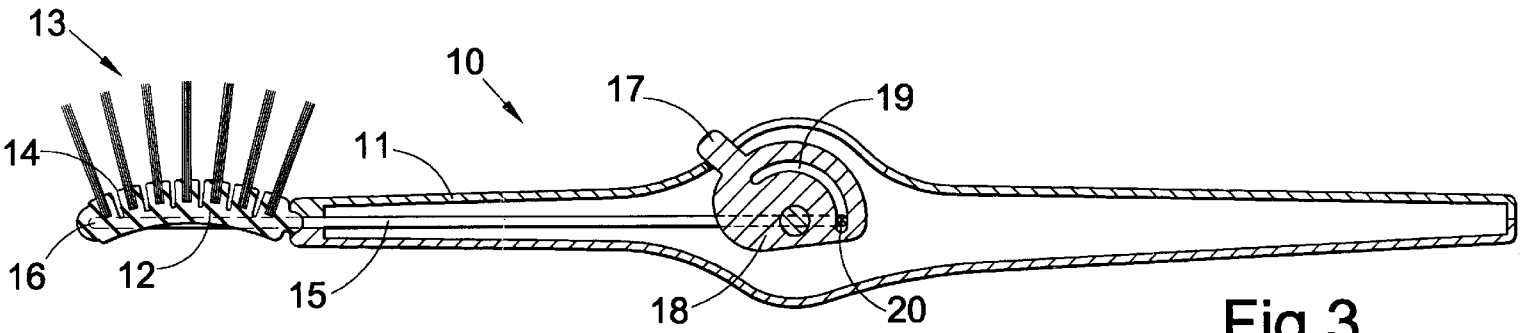
FIG. 3 is a sectional side view of the toothbrush in a further configuration.

Generally stated, the configuration used in FIG. 1 is preferred for thoroughly cleaning gaps between teeth when the end of the bristles are concentrated over a relatively small area. The configuration in FIG. 2 is normally used for cleaning outer surfaces of teeth and the configuration of FIG. 3 is normally used for up-and-down brushing. In any event, and as various shapes are required or desirable during each or a single tooth cleaning activity, the simple adjusting and retention of different selected shapes, as described, provides considerable advantages. The changes of shape can be achieved using one hand, the hand normally gripping the toothbrush, without having to touch the head or bristles to make the brush head shape changes.

I claim:

1. A toothbrush comprising:

an elongate shank with a longitudinal axis;

an elongate brush head formed of flexible material joined at a first end along said longitudinal axis to a remote end of said shank and carrying an array of bristles on a first surface of said brush head;

a straight push rod extending along said shank coupled to a remote end of said brush head and a lever mounted to said toothbrush for moving said push rod along said longitudinal axis to alter an effective length of said brush head and change the shape of said first surface of said brush head between a concave shape and a convex shape, said brush head is formed with laterally extending slots in said first surface to facilitate bending of said brush head into said concave and convex shape.

2. A toothbrush according to claim 1 wherein said lever is rotatably mounted to said toothbrush and formed with an arcuate surface that is mechanically coupled to one end of said push rod so that when said lever is rotated said push rod is moved along said longitudinal axis.

3. A toothbrush according to claim 2 wherein said arcuate surface is formed with steps that determine incremental movement of said push rod as said lever is rotated.

4. A toothbrush according to claim 2 wherein said lever is mounted inside said toothbrush and extends proud of an exterior surface of said toothbrush to enable an exposed part of said lever to be conveniently thumb-operated to adjust the shape of said head.

* * * * *